US007147287B2

(12) United States Patent
Kuivala

(10) Patent No.: US 7,147,287 B2
(45) Date of Patent: Dec. 12, 2006

(54) SEAT

(75) Inventor: Henri Kuivala, Pöytyä (FI)

(73) Assignee: Tunturi Oy Ltd, Turku (FI)

( * ) Notice: Subject to any disclaimer, the term of this patent is extended or adjusted under 35 U.S.C. 154(b) by 0 days.

(21) Appl. No.: 11/046,754

(22) Filed: Feb. 1, 2005

(65) Prior Publication Data

US 2005/0200182 A1 Sep. 15, 2005

(30) Foreign Application Priority Data

Feb. 10, 2004 (FI) ..... 20045032

(51) Int. Cl.
*A47C 1/02* (2006.01)

(52) U.S. Cl. ..... 297/344.14; 297/354.1; 297/344.1; 482/57; 482/142

(58) Field of Classification Search ..... 297/354.1, 297/344.1, 344.11, 344.14; 482/57, 142, 482/96, 101
See application file for complete search history.

(56) References Cited

U.S. PATENT DOCUMENTS 1,191,269 A * 7/1916 Balser ..... 297/344.14
4,092,009 A * 5/1978 Koutsky ..... 248/421
5,350,346 A 9/1994 Martinez
6,168,553 B1 1/2001 Kuo
6,743,158 B1 * 6/2004 Giannelli et al. ..... 482/96

FOREIGN PATENT DOCUMENTS

GB 28096 A 8/1913
JP 59 195427 A 6/1984

* cited by examiner

*Primary Examiner*—Laurie K. Cranmer
(74) *Attorney, Agent, or Firm*—Birch, Stewart, Kolasch & Birch, LLP

(57) ABSTRACT

A seat including a frame section and a seat section and backrest arranged thereon. The frame section is arranged movably in the back and forth direction to the base of the seat, whereby the backrest is pivotally connected to the frame section by a first lever structure for adjusting the tilt of the backrest. A second lever structure is pivotally connected to the frame section, and in one position it is arranged to lock the frame section to the base and in another position to release the frame section to move back and forth for longitudinal adjustment of the seat. The seat including an adjustment arranged to affect both the first and the second lever structure so that moving it in one way is arranged to affect the first and moving it in another way is arranged to affect the second lever structure.

5 Claims, 1 Drawing Sheet

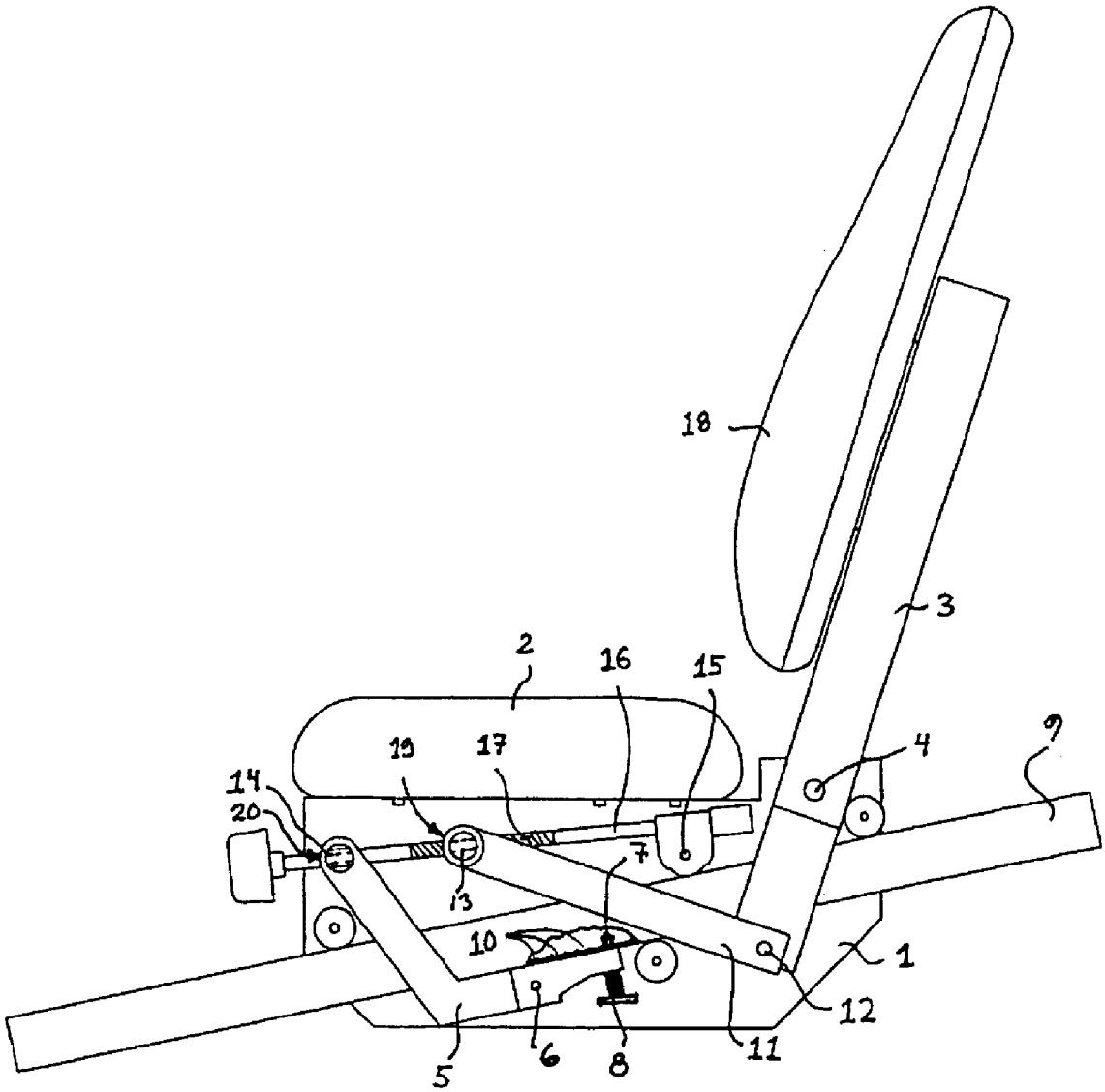
18
3
2
16
15
19
17
4
9
14
20
13
7
10
1
12
5
6
8
11

SEAT

BACKGROUND OF THE INVENTION

1. Field of the Invention

The invention relates to a seat that comprises a frame section and a seat section and backrest arranged on the frame section, the frame section being arranged movably in the back and forth direction to the base of the seat, whereby the backrest is pivotally connected to the frame section by means of a first lever structure for adjusting the tilt of the backrest, and a second lever structure is pivotally connected to the frame section to lock in one position the frame section to the base and to release in another position the frame section to move back and forth for longitudinal adjustment of the seat.

2. Discussion of the Background

Such seat solutions are today known for instance in different apparatuses used for keeping fit. Examples of such apparatuses are exercise bicycles and ergometers, especially recumbent exercise bicycles and ergometers and also recumbent bicycles.

A drawback with the prior-art solutions is their difficult use, because making adjustments requires the use of separate control levers or the like. The use of separate control levers and other corresponding devices has, in some cases, led to a relatively complex structure, also resulting in the increased number of different parts that increases both the manufacturing costs and spare part costs, because the number of parts to be kept in stock may in some cases become relatively high.

SUMMARY OF THE INVENTION

It is an object of the invention to provide a seat, by means of which the drawbacks of the prior art can be eliminated. This is achieved with the seat of the invention. The seat of the invention is characterized in that it comprises an adjustment means arranged to affect both the first lever structure and the second lever structure so that moving the adjustment means in one way is arranged to affect the first lever structure and moving it in another way is arranged to affect the second lever structure.

An advantage of the invention is that it is simple, whereby the manufacturing costs remain low. A simple structure also results in low maintenance costs. The seat of the invention is also very user-friendly, because adjustments with one adjustment device are considered very easy to make. The adjustment device of the invention can be located ergonomically very advantageously, which in turn increases the user-friendliness. A further advantage of the seat of the invention is that the mechanism can in a very advantageous manner be made such that the locks cannot unexpectedly open nor the adjustments change. In the seat of the invention, the adjustments lock automatically when the user releases his grip of the adjustment means, no separate locking actions or tightening of the locking means need to be performed.

BRIEF DESCRIPTION OF THE DRAWINGS

In the following, the invention will be described in greater detail by means of an application example shown in the attached drawing, in which the only FIGURE of the drawing shows the seat of the invention in a general side view.

DETAILED DESCRIPTION OF THE PREFERRED EMBODIMENTS

The FIGURE shows the seat of the invention in general. Reference number 1 indicates the frame section in the figure. The seat section 2 and backrest 18 are arranged on the frame section 1. The frame section 1 is arranged movably in the back and forth direction to the base 9 of the seat. The frame section 1 can move on the base 9 for instance on rollers as shown in the example of the FIGURE. The backrest 18 is pivotally connected to the frame section 1 by means of the first lever structure 3, 11, 4, 12 for adjusting the tilt of the backrest 18. Reference numbers 4 and 12 show the hinges. The second lever structure 5, 6 is also pivotally connected to the frame section 1, and, in one position, it is arranged to lock the frame section 1 to the base 9 and, in another position, it is arranged to release the frame section 1 to move back and forth for adjusting the longitudinal setting of the seat. Reference number 6 shows the hinge.

According to an essential idea of the invention, the seat comprises an adjustment means 16 arranged to affect both the first lever structure 3, 11, 4, 12 and the second lever structure 5, 6 so that moving the adjustment means 16 in one way, for instance turning it to left or right, is arranged to affect the first lever structure 3, 11, 4, 12, and moving it in another way, for instance lifting it up or pressing it down, is arranged to affect the second lever structure 5, 6.

The adjustment means 16 can preferably be a rod connected at one end by means of a hinge 15 to the frame section 1 and with a threaded transmission 13, 19 to the first lever structure 3, 11, 4, 12 and with a slide fit 14, 20 to the second lever structure 5, 6. The turning of the rod 16 is arranged to adjust the tilt of the backrest 18, and moving the free end of the rod 16 vertically in one direction, up in the example of the FIGURE, is arranged to release the locking of the frame section 1 from the base 9, and moving it vertically in the opposite direction, down in the example of the FIGURE, is arranged to lock the frame section 1 to the base 9. The arrangement of the FIGURE provides an automatic locking, because by suitably dimensioning the lever structure 5, 6, a gravitational locking is achieved; in other words, the free end of the rod 16 presses down due to gravity immediately when the user releases his grip, whereby the frame section locks in place. The tilt adjustment of the backrest also locks automatically in place when using screw transmission, as described in the following.

The threaded transmission 13, 19 can be implemented for instance by means of a hinged element 13 with a threaded through-hole 19 perpendicular to the spin axis of the hinge. The rod used as the adjustment means 16 can be threaded either on its entire length or on part of its length. The above-mentioned arrangement provides a stepless tilt adjustment of the backrest. The threads of the rod are marked with reference number 17.

The slide fit 14, 20 can in turn be implemented by means of a hinged element 14 with a through-hole 20 perpendicular to the spin axis of the hinge. The rod is arranged to pass through a hole 20 so that the rod can slide longitudinally through the hole.

The second lever structure 5, 6 comprises a part 7 that serves as a locking element and is arranged to press in a form-fit manner against a counter-surface 10 on the base 9 and thus to lock the frame section 1 to the base 9. The part 7 serving as the locking element can be a pin, for instance, and the counter-surface 10 can be a hole in the base, for instance. The locking of the frame section 1 can preferably be secured for instance by arranging the part 7 serving as the locking element to press against the counter-surface 10 assisted by a spring element 8.

The application example described above is in no way intended to restrict the invention, and the invention can naturally be modified freely within the scope of the claims. Thus, it is clear that the seat of the invention and some of its details need not be exactly as shown in the FIGURE, and solutions of other type are also possible. For instance, the locking of the frame section need not necessarily be implemented steplessly with the pin-hole principle, i.e. the invention is not limited to this locking method. Locking can be also be implemented so that an element serving as the locking element, such as a protrusion, is arranged at the end of the second lever structure 5, 6 to press against the base 9 and to keep the frame section in place by means of friction when pressing against the base, etc. The base can also be implemented in a different manner than in the figure. In the example of the FIGURE, the base is formed of a main beam that can be part of the frame of the exercise device, for instance. The rod serving as the adjustment means can be equipped with any suitable means for the user to seize, such as a thumb wheel, knob, crank or the like. An engine drive is also possible in connection with the seat of the invention.

The invention claimed is:

1. A seat that comprises a frame section and a seat section and backrest arranged on the frame section, the frame section being arranged movably in the back and forth direction to a base of the seat, whereby the backrest is pivotally connected to the frame section by means of a first lever structure for adjusting the tilt of the backrest, and a second lever structure is pivotally connected to the frame section to lock in one position the frame section to the base and to release in another position the frame section to move back and forth for longitudinal adjustment of the seat, wherein the seat comprises an adjustment means arranged to affect both the first lever structure and the second lever structure so that moving the adjustment means in one way is arranged to affect the first lever structure and moving it in another way is arranged to affect the second lever structure.

2. A seat as claimed in claim 1, wherein the adjustment means is a rod that is at one end thereof connected by means of a hinge to the frame section and connected with a thread transmission to the first lever structure and with a slide fit to the second lever structure, and that the turning of the rod is arranged to adjust the tilt of the backrest, and moving the free end of the rod vertically in one direction is arranged to release the locking of the frame section from the base, and moving it vertically in the opposite direction is arranged to lock the frame section to the base.

3. A seat as claimed in claim 2, wherein the second lever section comprises a part that serves as a locking element and is arranged to press in a form-fit manner against a counter-surface on the base and thus to lock the frame section to the base.

4. A seat as claimed in claim 3, wherein the part serving as the locking element is a pin and the counter-surface is a hole in the base.

5. A seat as claimed in claim 3 or 4, wherein the part serving as the locking element is arranged to press against the counter-surface assisted by a spring element.

* * * * *